US006802620B2

(12) United States Patent
Galli

(10) Patent No.: US 6,802,620 B2
(45) Date of Patent: Oct. 12, 2004

(54) FLASHLIGHT HOUSING WITH A KEY RING EXTENSION

(76) Inventor: Robert Galli, 8176 Horseshoe Bend La., Las Vegas, NV (US) 89113

( * ) Notice: Subject to any disclaimer, the term of this patent is extended or adjusted under 35 U.S.C. 154(b) by 46 days.

(21) Appl. No.: 10/307,782

(22) Filed: Dec. 2, 2002

(65) Prior Publication Data

US 2003/0076674 A1 Apr. 24, 2003

Related U.S. Application Data

(63) Continuation-in-part of application No. 09/976,611, filed on Oct. 12, 2001, now Pat. No. 6,527,419.

(51) Int. Cl.[7] ..... F21V 33/00

(52) U.S. Cl. ..... 362/116; 362/109; 362/800; 362/310; 362/200; 362/196; 362/311; 24/3.1

(58) Field of Search ..... 362/116, 109, 362/800, 308, 310, 200, 196, 311, 335; 24/3.1, 3.6, 3.12, 600.5, 600.6, 600.7

(56) References Cited

U.S. PATENT DOCUMENTS

| | | | | |
|---|---|---|---|---|
| 762,720 | A | 6/1904 | Hubert | |
| 1,047,525 | A | 12/1912 | Hubert | |
| 1,436,340 | A | 11/1922 | Gallagher | |
| 1,866,600 | A | 7/1932 | Rauch | |
| 2,412,056 | A | 12/1946 | Mosch | |
| 2,465,114 | A | 3/1949 | Qury | |
| 2,591,112 | A | 4/1952 | Zwierynski | |
| 2,708,073 | A | 5/1955 | Mohylowski | |
| 2,714,152 | A | 7/1955 | Ackerman et al. | 562/116 |
| 2,762,907 | A | 9/1956 | Schwartz | |
| 2,889,450 | A | 6/1959 | Nordquist et al. | |
| 3,057,992 | A | 10/1962 | Baker | |
| 3,085,149 | A | 4/1963 | Giwosky | |
| 3,085,150 | A | 4/1963 | Bautsch | |
| 3,119,564 | A | 1/1964 | Zalman | |
| 3,256,428 | A | 6/1966 | Schwartz | |
| 3,296,429 | A | 1/1967 | Schwartz | |
| 3,310,668 | A | 3/1967 | Schwartz | |
| 3,345,508 | A | 10/1967 | Chung | |
| 3,359,411 | A | 12/1967 | Schwartz | |
| 3,613,414 | A | 10/1971 | Ostrager | |
| 3,732,414 | A | 5/1973 | Franc | 240/10.61 |
| 3,804,307 | A | 4/1974 | Johnston | 224/28 |
| 3,866,035 | A | 2/1975 | Richey, Jr. | 240/6.4 |
| 3,870,843 | A | 3/1975 | Witte | 200/302 |
| 4,076,976 | A | 2/1978 | Fenton | 362/104 |
| 4,085,315 | A | 4/1978 | Wolter et al. | 362/116 |

(List continued on next page.)

FOREIGN PATENT DOCUMENTS

| | | | |
|---|---|---|---|
| GB | 2 314 150 | 12/1997 | F21L/7/00 |

OTHER PUBLICATIONS

Photo Micron–Light Catalog and LRI Company Profile, Mar. 21, 2001, Chicago Miniature Lamp, Inc., catalog pages, 1998, Snaptron, Inc., catolog pages, 2000.

Photo Micro–Light, 2000 American National Standard Insitute, ANSI C79.1–1994, Nomenclature for Glass Bulbs . . . Norme Internationale–International Standard, CEI IEC 60983–Miniature Lamps.

*Primary Examiner*—Thomas M. Sember
(74) *Attorney, Agent, or Firm*—Barlow, Josephs & Holmes, Ltd.

(57) ABSTRACT

The present invention includes an illumination assembly consisting of a light source such as a light emitting diode (LED) that produces a near field image and a means of imaging and focusing the near field image. The means for imaging and focusing the near field image is a convex optical lens having a radius of curvature equal to twice the overall thickness of the lens. The optical lens is installed in fixed spaced relation to the LED such that the lens is imaging the reflector cup of the LED rather than the light on the surface clear LED housing. The lighting assembly is enclosed in a flashlight housing having a means for operating the lighting circuit, a means for retaining a power source and a key ring extension with a slidable latching mechanism.

13 Claims, 6 Drawing Sheets

U.S. PATENT DOCUMENTS

| | | | | | |
|---|---|---|---|---|---|
| 4,101,955 | A | | 7/1978 | DuNah | 362/104 |
| 4,122,510 | A | | 10/1978 | Halliday, Jr. | 362/189 |
| 4,129,899 | A | | 12/1978 | Dunbar | 362/109 |
| 4,210,953 | A | | 7/1980 | Stone | 362/189 |
| 4,228,484 | A | | 10/1980 | Johnstone | 362/184 |
| 4,261,026 | A | | 4/1981 | Bolha | 362/101 |
| 4,276,582 | A | | 6/1981 | Burnett | 362/116 |
| 4,303,966 | A | | 12/1981 | Wolter | 362/116 |
| 4,336,574 | A | | 6/1982 | Goodman | 362/101 |
| 4,346,329 | A | | 8/1982 | Schmidt | 315/51 |
| 4,388,673 | A | * | 6/1983 | Maglica | 362/183 |
| 4,392,186 | A | | 7/1983 | Cziment | 362/116 |
| 4,398,237 | A | | 8/1983 | Doyel | 362/186 |
| 4,399,495 | A | | 8/1983 | Leopoldi et al. | 362/189 |
| 4,408,261 | A | | 10/1983 | Polakoff | 362/104 |
| 4,422,131 | A | | 12/1983 | Clanton et al. | 362/186 |
| 4,433,365 | A | | 2/1984 | Rousseau | 362/189 |
| 4,517,627 | A | | 5/1985 | Bradford | 362/156 |
| 4,521,833 | A | | 6/1985 | Wolter | 362/116 |
| 4,524,409 | A | | 6/1985 | Yakubek | |
| D285,989 | S | | 10/1986 | MacDonald | |
| 4,628,418 | A | | 12/1986 | Chabria | |
| D290,518 | S | | 6/1987 | Rakocy et al. | |
| 4,731,712 | A | | 3/1988 | Amthor | 362/189 |
| 4,768,138 | A | | 8/1988 | Leopoldi et al. | 362/189 |
| 4,787,016 | A | | 11/1988 | Song | |
| 4,893,222 | A | | 1/1990 | Mintzer | 362/109 |
| D311,067 | S | | 10/1990 | Chabria | |
| 5,008,784 | A | | 4/1991 | Wang | 362/116 |
| 5,029,055 | A | | 7/1991 | Lindh | 362/191 |
| 5,043,854 | A | | 8/1991 | Gammache | 362/197 |
| 5,122,943 | A | | 6/1992 | Pugh | |
| 5,143,442 | A | | 9/1992 | Ishikawa et al. | |
| 5,158,356 | A | | 10/1992 | Guthrie | 362/188 |
| D337,200 | S | | 7/1993 | Keller | |
| 5,285,586 | A | | 2/1994 | Goldston et al. | 36/137 |
| 5,318,177 | A | | 6/1994 | Isacson | |
| 5,386,351 | A | | 1/1995 | Tabor | 362/201 |
| 5,457,613 | A | | 10/1995 | Vandenbelt et al. | 362/200 |
| 5,463,539 | A | | 10/1995 | Vandenbelt et al. | |
| 5,465,197 | A | | 11/1995 | Chien | 362/203 |
| 5,475,368 | A | | 12/1995 | Collins | 340/573 |
| 5,515,248 | A | | 5/1996 | Canfield et al. | |
| 5,521,725 | A | * | 5/1996 | Beeson et al. | 349/95 |
| 5,541,817 | A | | 7/1996 | Hung | 362/116 |
| D372,356 | S | | 8/1996 | Marguerite | |
| D381,803 | S | | 8/1997 | Crego | D3/208 |
| 5,730,013 | A | | 3/1998 | Huang | |
| D394,345 | S | | 5/1998 | Marguerie | |
| D400,326 | S | | 10/1998 | Fisher | D32/42 |
| D401,371 | S | | 11/1998 | Chen | |
| D402,069 | S | | 12/1998 | Chan | |
| 5,893,631 | A | | 4/1999 | Padden | 362/201 |
| 5,894,196 | A | | 4/1999 | McDermott | 313/512 |
| 5,927,846 | A | | 7/1999 | Sinclair | |
| 5,934,789 | A | | 8/1999 | Sinclair | |
| 5,956,985 | A | | 9/1999 | Chang | 70/456 |
| 5,983,686 | A | * | 11/1999 | Lee | 70/456 R |
| 6,006,562 | A | | 12/1999 | Wolter | |
| 6,039,454 | A | | 3/2000 | Hallgrimsson | |
| 6,070,990 | A | | 6/2000 | Dalton et al. | |
| 6,079,845 | A | * | 6/2000 | Kreider | 362/116 |
| 6,109,762 | A | | 8/2000 | Hallgrimsson et al. | 362/200 |
| 6,164,795 | A | | 12/2000 | Lopez | 362/116 |
| 6,190,018 | B1 | | 2/2001 | Parsons et al. | 362/116 |
| 6,523,973 | B2 | | 2/2003 | Galli | 362/200 |

* cited by examiner

FLASHLIGHT HOUSING WITH A KEY RING EXTENSION

CROSS-REFERENCE TO RELATED APPLICATIONS

This application is a continuation in part of and claims priority from earlier filed U.S. patent application Ser. No. 09/976,611, filed Oct. 12, 2001, U.S. Pat. No. 6,527,419.

BACKGROUND OF THE INVENTION

The present invention relates to optical lens and housing assemblies for use in lighting devices such as commercial and residential lighting fixtures, flashlights and miniature flashlights and more particularly to flashlight housings for use with lighting devices of the type employing a high brightness light emitting diode to provide a smooth uniform spotlight beam having sharp edges.

Most commercial lighting devices are designed to provide an on-axis, high intensity peak in their beam distribution as is typically found in flashlights with smooth reflectors. Attempts to provide a more uniform beam distribution include the use of multi-faceted reflectors, however, the resulting beam pattern tends to be Gaussian with no sharp edge between the area illuminated by the beam and the surrounding non-illuminated area. In both the faceted and unfaceted cases, the reflector tends to be parabolic in shape and essentially smears the image taken from the far field of the light source and projects that smeared image in the far field of the flashlight beam.

Other prior art attempts to produce a focused light source include the provision of a standard convex lens with a relatively long convergence factor in front of a Light Emitting Diode (LED) package. These devices also produce an unacceptable result as they capture the far field image from a plane projected in front of the LED package and simply enlarge that image in a reversed pattern in the flashlight beam far field. If the beam pattern is carefully studied, an image of the emitter die and diode reflector cup can be seen in the beam image.

In addition, to compliment the portable nature of these flashlight devices, a means for retaining them in a desired location is typically required. Often, this retaining means allows the light either to be clipped onto the user's apparel, such as to their belt loop, or onto the user's key ring. Generally, these devices have a pivotable latching mechanism that is spring biased into an outer closed position and operates inwardly allowing a loop to enter the mechanism but preventing its unintentional removal. However, in these prior art devices, the latch can be accidentally opened by exerting inward pressure on the face of the latch. This could happen for example when a user has the flashlight clipped onto their belt loop and leans against a counter or railing. In this manner, the light may become disengaged from its storage location and unintentionally lost.

Therefore, there is a need for a lighting device that produces a smooth, evenly distributed beam of light. In addition, there is a need for a lighting device that provides a high intensity beam of light that has a homogeneous illumination pattern. There is also a need for a high intensity flashlight beam that provides a uniform field of illumination and that has a sharp edge between the illuminated field and the non-illuminated field. There is a further need for a flashlight that has a clipping mechanism that is integral to the flashlight housing for retaining the flashlight that provides improved reliability and operating characteristics over the lights in the prior art.

SUMMARY OF THE INVENTION

In this regard, the present invention provides an improved LED lighting device for producing a high intensity focused light beam that has a uniform appearance across the entire field of illumination and that has a sharp defined edge between the illuminated and non-illuminated areas. The present invention is an improvement over the prior art in that it provides a uniform illumination pattern without producing peak illumination along the axis of the light beam and without creating "hot-spots" in the illumination field. In addition, unlike existing products that use parabolic reflectors for focusing the light beam, the uniformity of the pattern of light distribution is not dependant on the distance of the illuminated surface from the flashlight nor does the beam require refocusing as the distance between the light source and the illuminated surface increases.

More specifically, several novel elements are combined to result in the unique appearance of a focused uniform beam of light. The first element is the use of a specialized light emitting diode (LED) component. The LED used in the present invention is customized to provide a concentrated, uniform light output flux across the entire emitter die and reflector cup assembly. This is achieved by providing an LED that has a scatter layer coating, such as a phosphor slurry, covering the reflector cup and emitter die. The uniform scatter layer diffuses the energy emitted from the emitter die thereby causing it to be uniformly distributed over the entire surface of the reflector cup. This scattered light provides a high intensity and uniform light source that is used to generate a smooth and uniform near field light image at a plane located within the LED package between the emitter die and reflector cup assembly and the front of the LED package. The present further invention employs an LED having a clear optical housing with a narrow beam angle that preserves the concentrated near field light image produced by the lighting structure thereby allowing the compact light image to be captured and further focused and imaged into the far field light beam image of the present invention.

FIGS. 4 and 4*a*, illustrate two types of LED packages available in the prior art. LED packages are produced in both narrow (FIG. 4) and wide (FIG. 4*a*) beam angles. For purposes of the present invention and as generally understood in the field, the term narrow angle refers to an LED with a beam angle of less than 15° and wide angle indicates an LED with a beam angle of greater than 15°. Generally, the prior art LED packages have an emitter chip 70, a reflector cup 72 and an optical housing 74. As can be seen in the illustrations, the wide angle LED in FIG. 4*a* provides a greater amount of available luminous flux (illustrated by the ray trace lines) in the LED far field adjacent to the outer optical housing 74 of the LED. While the wide angle LED allows a greater amount of light to be controlled and therefore transmitted by the curved surface of the optical housing 74 thereby producing a greater amount of light, the output pattern and projected image is scattered which results in a very large and unfocused image of the LED package (cup and die) being transmitted to the LED far field. The narrow angle LED shown in FIG. 4, while transmitting less of the total available luminous flux into the far field of the LED, presents a narrower more focused image of the LED package in the LED far field. The present invention employs a narrow angle LED. Although this represents a trade-off in efficiency, in that all of the available luminous flux from the LED is not captured and projected into the far field of the beam, as will be seen later in the description, a high quality focused LED near field image is critical to produce a level beam output.

The other element of the present invention is a unique optical lens that captures an image of the emitter die and reflector cup from the near field plane within the LED package and projects a uniform focused image of the LED near field in the far field of the light beam. This unique lens captures a clear near field image of the reflector cup and emitter die from inside the LED package without interference from the LED optical housing.

The use of the near field image of the LED as the imaging source is considered to be a significant improvement over the prior art. Until now, the prior art has only attempted to utilize the far field image created at a plane beyond the outer surface of the LED optical housing. In contrast, in the in the present invention, the image used to create the far field light image is actually a near field image as taken from a plane within the interior of the LED. This is achieved by the use of a spherical lens placed in close proximity to the LED package such that the convergence point of the lens falls behind the die and reflector cup of the LED. This arrangement captures an image across the entire face of the reflector cup rather that an image of the die alone or a diffuse image of the entire LED package as was the case in the prior art. This technique, referred to as defocusing, allows a uniform image to be obtained by reducing the bright spots and non-uniformities found in a focused image of the LED die alone. Also, this placement of the lens so as to capture an image at a plane along the interior of the LED package further allows the outer edge of the LED reflector cup and/or the circular outer wall of the LED package to act as a field stop to provide a sharp cutoff for the beam image in contrast to a lens placement further from the LED package that images a diffuse light image from the far field distribution of the LED package as a whole.

The present invention also provides a unique housing assembly for a flashlight wherein a unique key ring extension is formed as an extension of the flashlight housing. The key ring extension protrudes from the rear of the flashlight housing opposite the lighting element and forms a looped end with an opening along one side. A slidable latch is provided that can be operably slid to close the opening and close the loop. In this manner, the latch provides a positive closing action.

Accordingly, among the objects of the instant invention is the provision of an illumination assembly that has a focused high intensity beam. Another object of the present invention is the provision of a high intensity lighting assembly that provides a uniformly distributed beam having a far field light image that is uniform in appearance across the illuminated surface. In addition, an object of the present invention is to provide a high intensity light source that produces a focused beam of light having a uniform light distribution across the illuminated field while having a sharply focused and contrasted edge between the illuminated field and the non-illuminated field. Yet a further object of the present invention is the provision of a flashlight housing that includes a high intensity lighting assembly and a key ring extension that includes a slidable latch.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
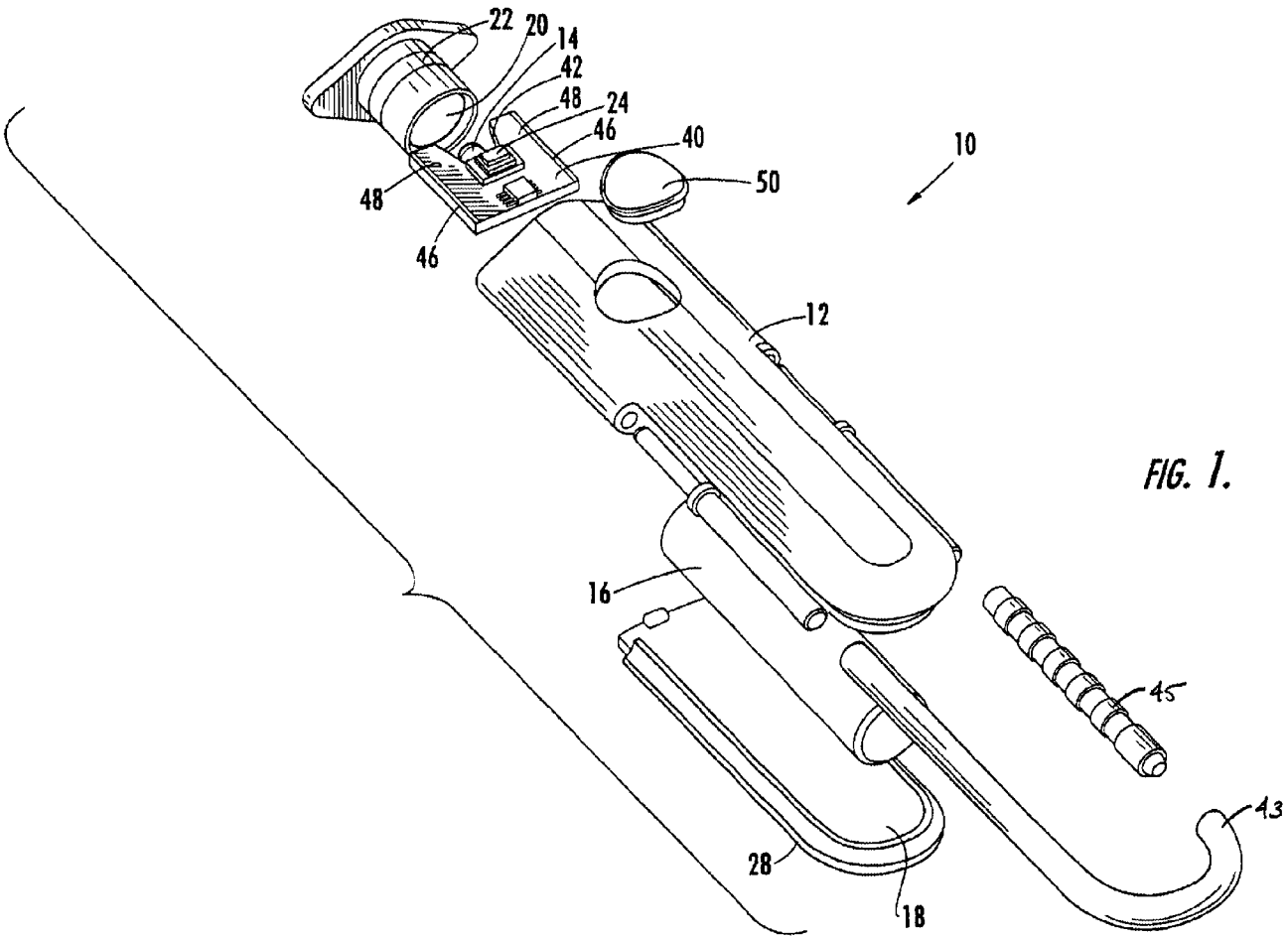
FIG. 1 is an exploded perspective view of the lighting assembly of the present invention.
Figure 2:
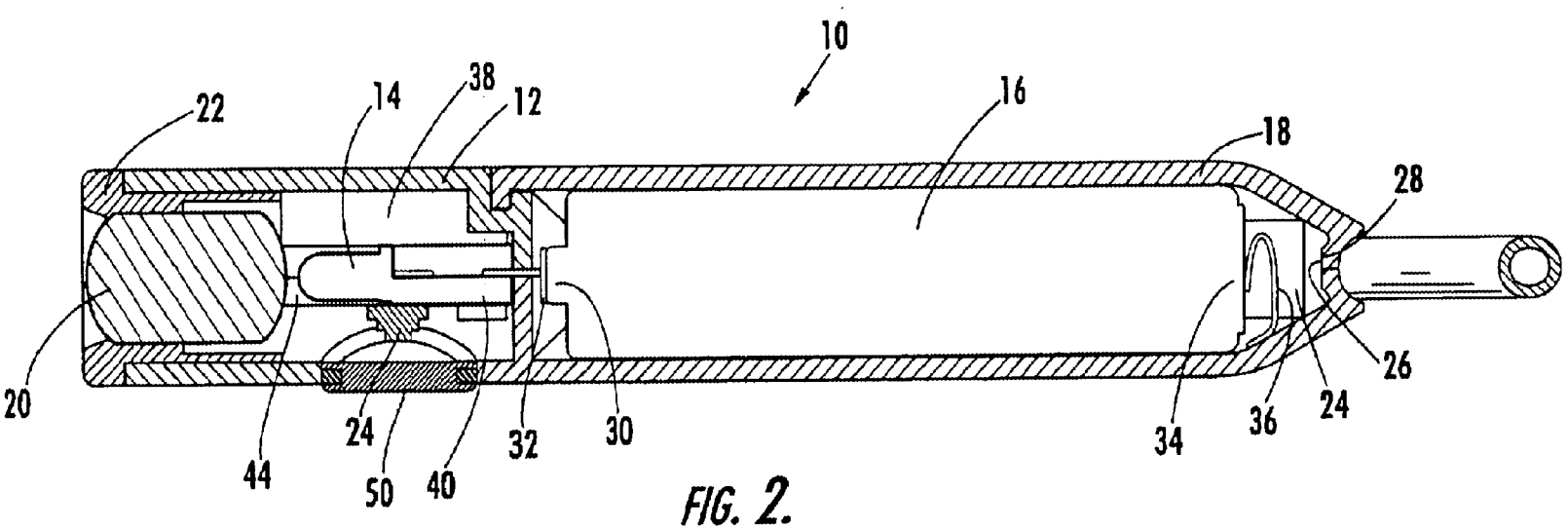
FIG. 2 is a cross-sectional view thereof.

Referring now to the drawings, the illumination assembly of the instant invention is illustrated and generally indicated as 10 in FIGS. 1 and 2. As will hereinafter be more fully described, the instant invention utilizes a high-brightness light emitting diode (LED), and a spherical optical lens in a simple housing that maintains both the LED and the lens in a fixed spaced relationship to provide a useful, novel and improved light source.

Turning to FIGS. 1 and 2, although the present invention may be employed in a variety of lighting devices, the preferred embodiment of the present invention is illustrated as a flashlight 10. The flashlight 10 comprises a housing generally indicated at 12, a light emitting diode (LED) generally indicated at 14, a battery generally indicated at 16, a cover generally indicated at 18, an optical lens 20, a mounting frame 22 for holding the lens 20 in position relative to the LED 14,and a switch 24 for selectively energizing the LED 14.

The housing 12 is generally an outer case for enclosing the battery 16, the LED 14 and the lens 20 and holding all of the components in operative relation. As can be seen, while the housing in FIGS. 1 and 2 is shown in a particular stylized manner, the present invention can be employed using a variety of housing shapes and sizes. As an example, a flashlight could be fabricated using the present invention but employing a housing having a more traditional round flashlight shape. In addition, a lighting device such as a commercial lighting fixture for use in lighting office environments or theatrical productions could also be fabricated using the present invention while being constructed with a variety of different housing configurations. Therefore, it is noted that the size and shape of the housing shown in FIGS. 1 and 2 is not critical to the device, and is not intended to limit the scope of the disclosure in any way. The housing 12 includes an interior cavity 24 for receiving the battery 16 and has a ridge 26 that cooperates with a corresponding ridge 28 in the cover to allow the cover 18 to be snap fit to the housing 12 thereby retaining the battery 16 in the interior cavity 24 and maintaining the battery 16 in an operative position. The battery 16 is installed within the interior cavity 24 having one end 30 in electrical communication with a contact pin 32 near the front end of the interior cavity 24 and a second end 34 in electrical communication with a second contact 36 near the rear of the interior cavity 24. Electrical power is thereby transferred from the battery 16 through these contacts 32, 36 for energizing the LED 14 in a manner as will be described later in this section.

The housing 12 further includes a cavity 38 near the front for receiving the LED 14, switch mechanism 24, lens 20 and lens mounting frame 22. The present embodiment discloses a circuit board 40 to which the LED 14 and switch mechanism 24 are rigidly attached. One lead of the LED 14 is in electrical communication with the second contact 36 of the battery 34 and the other lead of the LED 14 is in electrical communication with the switch mechanism 24. The switch mechanism 24 is a conventional micro-switch that is soldered onto the circuit board 40 and is in electrical communication on one side with the contact pin 32 and on the other side with one lead of the LED 14. The LED 14 is rigidly mounted to the circuit board 40 within a groove 42 near the front of the circuit board 40 and the circuit board 40 is received in the front cavity 38 of the housing 12 in a manner to result in precise placement of the LED 14 within the overall assembly. This precise location is achieved by providing slots 44 in the sidewalls of the front cavity 38 of the housing 12 that slideably receive tabs 46 along the sides of the circuit board 40 assembly. The front of the circuit board also has arms 48 on either side of the groove 42 to control the depth to which the lens 20 can be installed in the front cavity 38 thus providing an accurate spaced relationship between the LED 14 and the lens 20. The switch 24 has a normally open position and can be depressed to selectively close the circuit between the battery 16 and the LED 14 thus energizing the circuit. A resilient switch element 50 is installed in the side of the housing 12 in a location adjacent to the switch 24 and is depressed by the user to operatively engage and depress the switch 24 to selectively energize the LED 14.

Turning again to FIG. 1, the flashlight housing 12 further includes a key ring extension 43 that extends rearwardly from the housing 12. In the preferred embodiment, the key ring extension 43 would be formed from a tubular aluminum material and be bent in substantially a "J" shape. While shown as tubular aluminum, the key ring extension 43 could also be formed from injection molded plastic, bent wire, bar stock, or stamped from a sheet of raw material. Further, the key ring extension 43 could be integrally formed with the housing 12 of the flashlight 10. While specific structure is shown herein it is not intended to limit the scope of the disclosure, as it should be appreciated that a great variety of materials and configurations could be used to arrive at the disclosure of the present invention. A latching mechanism 45 is provided along the side of the housing 12 opposite the key ring extension 43. The latching mechanism 45 is a straight tubular element that is spring biased to engage the shorter leg of the "J" shaped key ring extension 43. The latching mechanism 45 is normally fully extended with one end engaging the key ring extension 43 and is slideably operable to provide an opening whereby the key ring extension 43 can be latched onto a desired object.

The lens of the present invention is installed in a lens-mounting frame 22 and fastened in place using a potting compound or conventional epoxy. The mounting frame 22 is then installed into the end of the front cavity 38 of the housing 12 to a depth where the mounting frame 22 contacts the arms 48 of the circuit board 40. This manner of installation provides a predictable and repeatable spaced relationship between the LED 14 and the lens 20. While this particular means of mounting the lens 20 has been found to be effective, it should nevertheless be understood that other means for mounting the lens 20 are possible within the scope of the invention.

Figure 3:
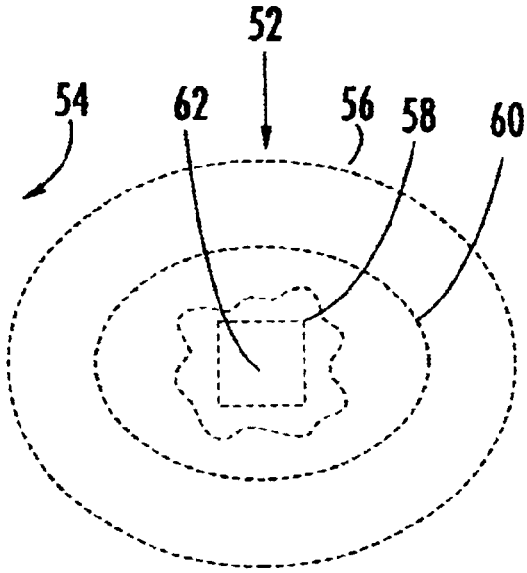
FIG. 3. (PRIOR ART)
FIG. 3 is a plan view showing the light beam pattern of a prior art lighting assembly.
Figure 3A:
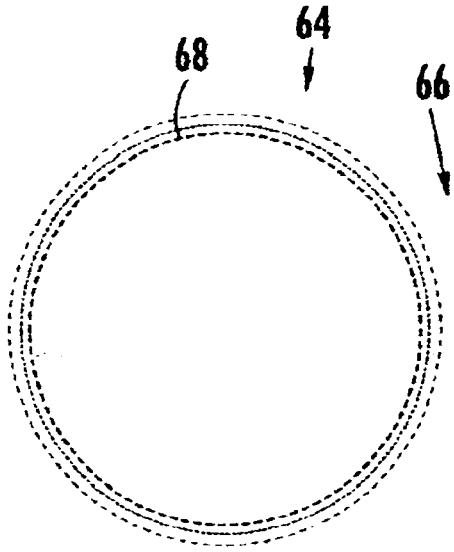
FIG. 3*a* is a plan view showing the light beam pattern of the present invention.

Turning now to FIGS. 3 and 3*a*, images from a prior art conventional LED flashlight using a standard piano convex lens (FIG. 3) and from a flashlight of the present invention (FIG. 3*a*) are shown adjacent to one another for comparison purposes. The image in FIG. 3 can be seen to have poor definition 56 between the illuminated 52 and non-illuminated field 54 areas and an uneven intensity of light can be seen over the entire plane of the illuminated field 52. Areas of high intensity can be witnessed around the perimeter 60 of the illuminated field and in an annular ring 58 near the center of the field. In addition, a particularly high intensity area 62 of illumination can be seen in a square box at the center of the field and corresponds to the location of the emitter chip within the LED package. In contrast, FIG. 3*a* shows an image from the present invention. Note that the illuminated field 64 has a uniform pattern of illumination across the entire plane and the edge 68 between the illuminated 64 and non-illuminated 66 fields is clear and well defined providing high levels of contrast. The selection of LED 14 and optical lens 20 in addition to the relationship between the LED 14 and optical lens 20 are critical to the operation of the present invention and in providing the results shown in the illumination field in FIG. 3*a*.

Figure 4:
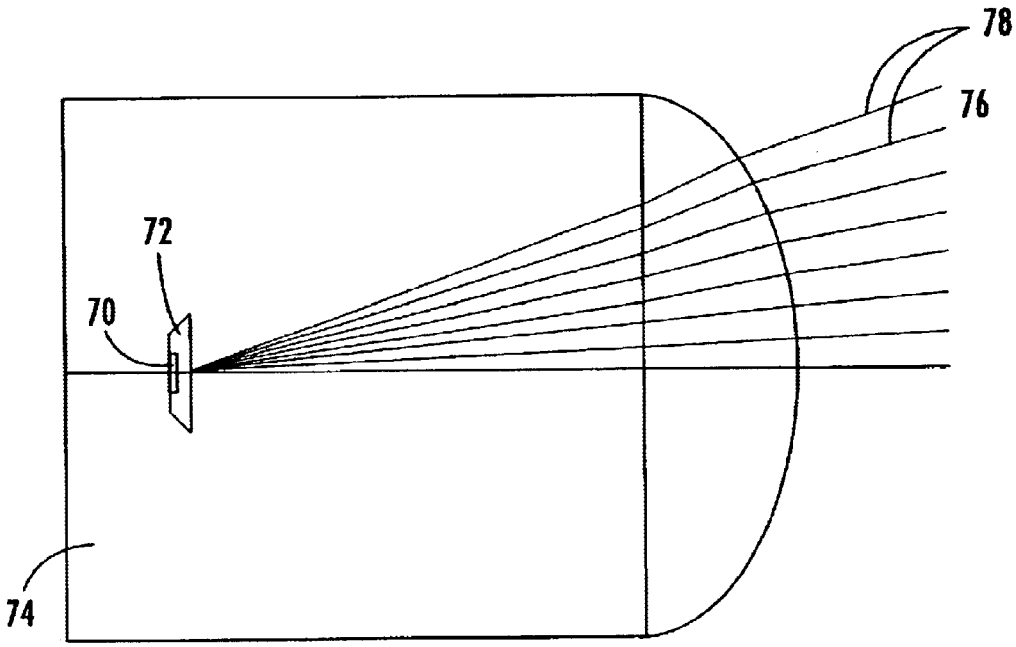
FIG. 4. PRIOR ART
FIG. 4 is a cross sectional view of the light distribution of a prior art narrow beam angle light emitting diode.
Figure 4A:
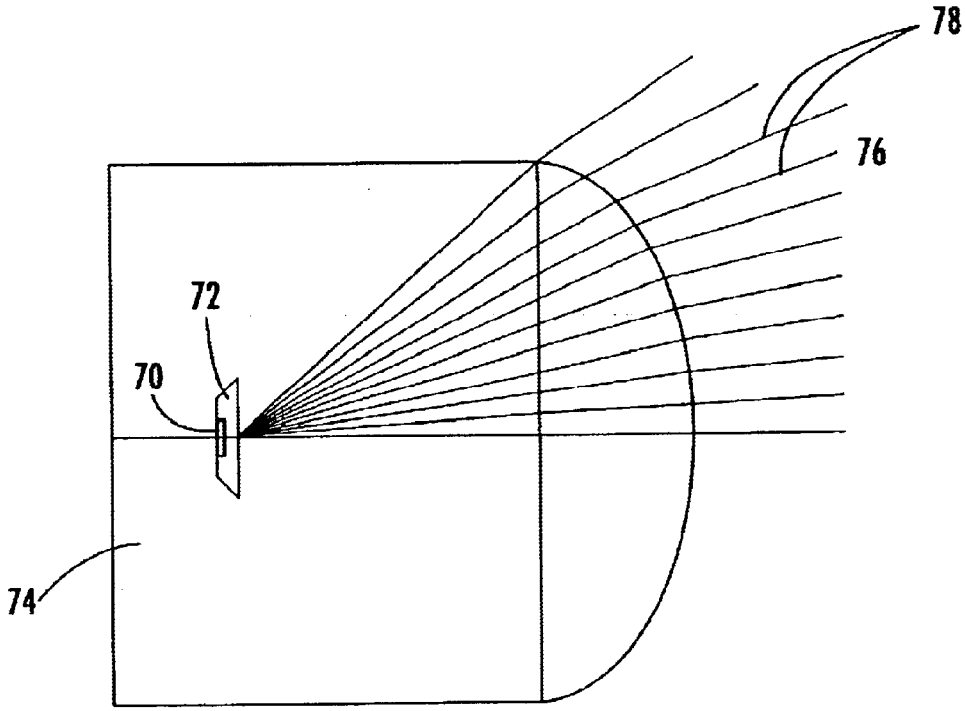
FIG. 4a. (PRIOR ART)
FIG. 4*a* is a cross sectional view of the light distribution of a prior art wide beam angle light emitting diode.

As was discussed earlier, the prior art LED's illustrated in FIGS. 4 and 4*a*, are available in both narrow (FIG. 4) and wide (FIG. 4*a*) beam angles. For the reasons stated above, the present invention employs a narrow angle LED. The narrow angle LED presents a concentrated available image of the entire near field plane of the reflector cup and die as well as a uniformly illuminated image of the interior of the LED optical housing for projection in its entirety to the far field of the LED as contrasted to the wide angle LED that provides a scattered image of only a portion of the entire reflector cup. This enables the present invention to capture a near field image from a plane on the interior of the LED without substantial interference from the LED optical housing and having a luminous flux distribution with a sharp cutoff edge corresponding to the edge of the reflector cup or the outer circular edge of the LED optical housing at a plane adjacent to the reflector cup. However, because of the sharp focus of the image and the intensity of the resulting light output, the image is susceptible to any imperfections found in the surface of the die and reflector cup. While, the present invention therefore selects a narrow angle LED, it also further modifies it as described below to arrive at the intended result.

Figure 5:
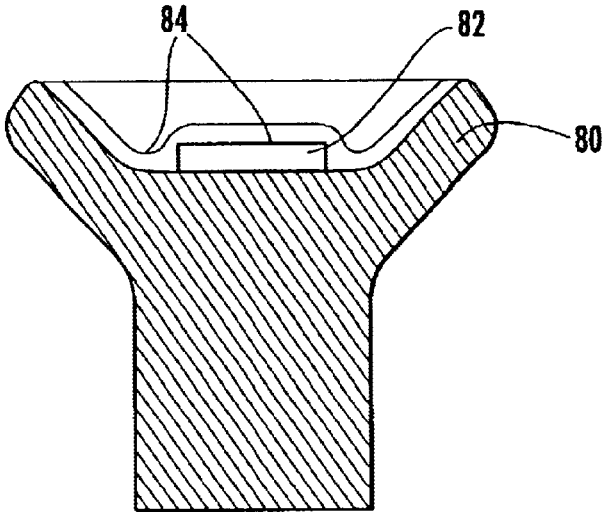
FIG. 5 is a cross-sectional view of the die/cup of the light emitting diode of the present invention.

A cross section of the LED reflector cup 80 and emitter chip 82 employed in the present invention is shown in FIG. 5. To provide an uniformly illuminated near field image, a narrow angle LED package is modified by applying a scatter layer 84 on the inner surface of the reflector cup 80 and over the emitter chip 82. The scatter layer 84 serves to flatten and disburse the hot spots produced in the LED package that result from imperfections in the die and reflector cup and create uniformity in the intensity of the image produced by the package. In this regard, the present invention preferably utilizes a white light LED. A narrow beam angle, white light LED of the type contemplated for use in the present invention is commercially available from the Nichia America Corporation. The Nichia white light LED's employ a proprietary blue light emitter die having a coating of phosphor disbursed over the die cup. The blue light from the emitter die excites the phosphor coating and causes the coating to emit light in the green and red wavelengths and provide a balanced white light. In this case, the phosphor coating serves as the scatter layer 84 to provide the desired uniform light pattern. The scatter layer may alternatively be other material in other non-white LED packages where the scatter layer simply serves to diffuse the luminous flux from the emitter chip 82 over the entire surface of the reflector cup 80. While scatter layers have been utilized in prior art LED's, the prior art lighting devices have only used the image generated in the far field of the LED. As a result, prior art devices begin with a light image that is already diffused and lacking in definition thus generating an uneven light pattern in the far field of the light beam.

Figure 6:
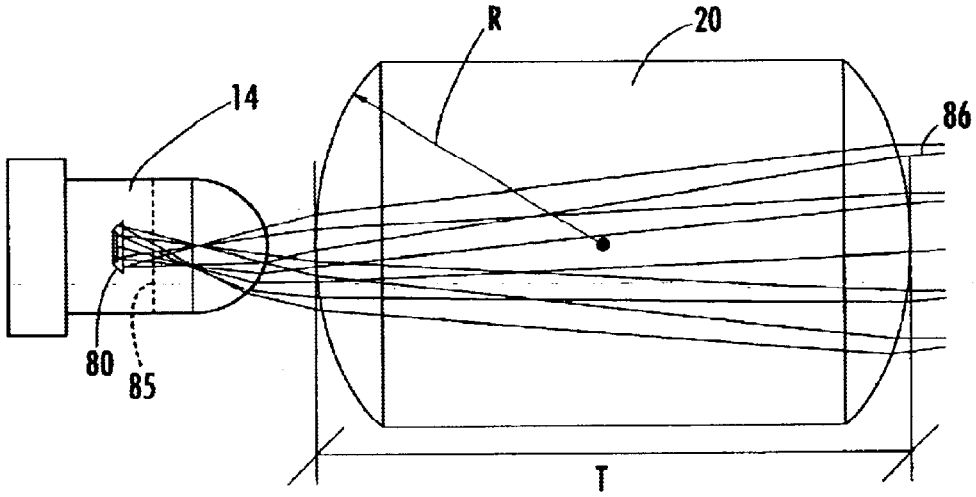
FIG. 6 is a schematic view of the light emitting diode and optical lens of the present invention.

Finally, referring to FIG. 6, the operative relationship between the LED 14 and the spherical lens 20 of the present invention is shown. A spherical lens 20 is employed in the present invention. The objective is to place the lens in operative relation to the LED to capture an image of the LED near field plane. The lens is defined by the fact that the radius R of convex curvature of the lens is equal to one half of the thickness T of the overall lens thus providing a perfect sphere, i.e. T is equal to the diameter D of the sphere. In the present embodiment, the lens 20 is shown as a cylindrical core removed from the center of the sphere as the material falling around the periphery of the lens is optically insignificant to the projection of the light image and therefore not required. The present invention may however employ either a full sphere, or the cylindrical portion of a sphere shown in FIG. 6 to arrive at the same result. The spherical lens 20 is placed in close proximity to the front of the LED package 14. As can be seen, a narrow angle LED 14 is used to provide a concentrated near field image at the face of the LED 14 that includes an image of the entire surface of the reflector cup 80. As was earlier demonstrated, a wide angle LED does not allow an image of the entire reflector cup to be seen in the LED near field. The spherical lens 20 is located at a distance from the LED to allow points located in the far field of the lens to be traced back in such a manner that the rays 86 all contact a near field point on a plane within the LED package located at or near the surface of the LED reflector cup 80. The placement of the lens assists in capturing the near field of the die and reflector cup that is produced in sharp focus by the narrow angle LED without significant interference from the optical housing of the LED. The image thus projected into the spherical lens 20 far field is an image of the uniformly illuminated reflector cup 80 within the LED 14 package and not the image at the front surface of the LED 14. The resulting image has a uniform light distribution across the illuminated field, as it is an image across the uniform illumination output of the scatter layer. In addition, the image in the far field of the lens 20 has a sharp focused cut off edge between the illuminated field and the non-illuminated field, resulting from the image of the circular edges of the LED 14 package at the plane 85 adjacent to the reflector cup 80 of the LED 14 package. Since the image is a self contained image of only the package of the LED 14 at a plane 85 adjacent to the reflector cup 80, and the uniform illumination is contained within the limits of the LED 14 package due to the reflective nature of the inner surface of the optical housing, the near field illumination plane 85 of the LED 14 has a sharp edge and therefore the projected image in the far field of the lens 20 also has a sharp edge. The location of the near field image plane 85 can be located at any point between the reflector cup 80 and the transition point where the front of the LED 14 housing begins to taper. The location of the near field image plane 85 is adjusted by moving the lens 20 either closer to or further from the front of the LED 14 housing thus locating the convergence point of the lens at an optimum location to maximize the brightness and clarity of the near field image captured. This arrangement provides a unique and well-defined contrast between the illuminated and non-illuminated fields in the lens far field.

Figure 7:
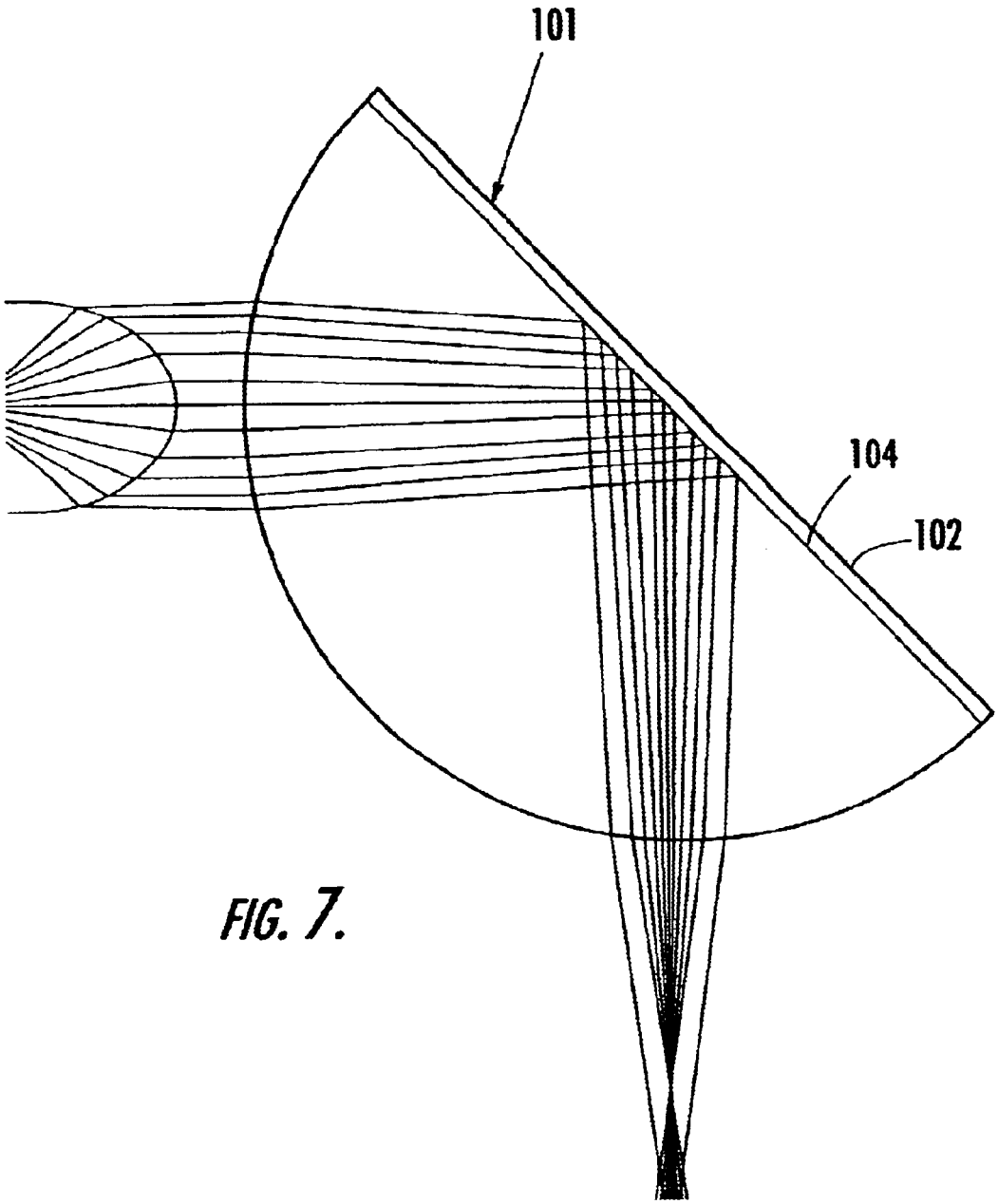
FIG. 7 is a view of an alternate embodiment of the spherical lens of the present invention.

An alternative embodiment of the present invention is shown in FIG. 7. The spherical lens 101 of the present invention is shown as being cut in half with a reflective coating 102 applied to the outside of the cut surface 104. The optical performance of the present invention is the same as provided in the drum lens in that a near field image of the entire LED reflector cup 80 is transmitted into the lens far field. This variation results, however, in projecting the image at a 90-degree angle from the axis of the LED source axis.

It can therefore be seen that the instant invention provides a unique and efficient means for providing a highly focused evenly distributed beam of light. In addition, the present invention provides a far field beam image with a high level of uniformity and definition between the illuminated field and the non-illuminated field. For these reasons, the instant invention is believed to represent a significant advancement in the art that has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A flashlight assembly comprising:

light-producing element having first and second contact leads extending therefrom:

a power source having a first contact and a second contact;

a housing having a first end and a second end, said housing enclosing the leads of the light-producing element and the power source;

a switch operable to close a circuit including the light-producing element and the power source;

a key ring extension extending from the second end of the housing having an opening whereby an object can be attached to the key ring extension; and a key ring lock slideably connected to the housing wherein, upon exerting a linear force against the key ring lock, the key ring lock slides away from the key ring extension out of the opening to permit a key ring to be attached to the key ring extension.

2. The flashlight assembly of claim 1, wherein the key ring lock is spring biased and exerts a force against one end of the key ring extension.

3. The flashlight assembly of claim 1, wherein the key ring extension extends rearwardly from a first side of the housing and the key ring lock extends rearwardly from a second side of the housing opposite said first side.

4. The flashlight assembly of claim 1 wherein, said light producing element is a light emitting diode.

5. The flashlight assembly of claim 4, further comprising:

a lens installed into said first end of said housing, said lens having a focal length for imaging and focusing a near field image of said light producing element, said lens having a thickness and a radius of curvature, said thickness equaling twice the radius of curvature.

6. The illumination assembly of claim 5 wherein, said optical lens is a sphere.

7. The illumination assembly of claim 5 wherein, said optical lens is a drum lens.

8. The illumination assembly of claim 5, wherein said optical lens is in fixed spaced relation to said light emitting diode.

9. The Illumination assembly of claim 8, wherein said fixed z spaced relation is less than the focal length of said optical lens.

10. A housing for a flashlight comprising:

a base having an outer side wall, said outer side wall defining an interior cavity, said outer side wall having a front opening capable of receiving a light producing assembly and a rear cavity capable of receiving a battery;

a cover having a top wall adapted to overlie arid substantially close said rear cavity, said cover including mating formations, said mating formations interfittingly engaging said rear cavity of said base to retain said base and said cover in assembled relation;

an elastomeric switch element disposed in said sidewall of said base;

a key ring extension extending from the base having an opening whereby an object can be attached to the key ring extension; and a key ring lock slideably connected to the housing wherein, upon exerting a linear force against the key ring jock, the key ring lock slides away from the key ring extension out of the opening to permit a key ring to be attached to the key ring extension.

11. The housing for a flashlight of claim 10, wherein the key ring look is spring biased and exerts a force against one end of the key ring extension.

12. The housing for a flashlight of claim 10, wherein the key ring extension extends rearwardly from a first side of the housing and the key ring lock extends rearwardly from a second side of the housing opposite said first side.

13. A flashlight assembly comprising:

a flashlight having an outer housing; and a key ring extension extending rearwardly from said outer housing, said key ring extension including a hook and a latch, said hook having a first end connected to said outer housing and a second, tree end opposite said first end, said latch being slideably mounted to said housing, wherein said latch is spring biased in a first direction against said free end of said hook wherein, upon exerting a linear force against said latch, the latch slides away from the free end of the hook to permit a key ring to be attached to the hook.

* * * * *